US008235263B1

(12) United States Patent
Yeates et al.

(10) Patent No.: US 8,235,263 B1
(45) **Date of Patent: *Aug. 7, 2012**

(54) RETENTION HOLSTER HAVING A GUARD AND GUARD RELEASE

(75) Inventors: Eric M. Yeates, Virgina Beach, VA (US); Clifton L. Cook, Chesapeake, VA (US); Thomas M. Gregory, Belgrade, MT (US); Robert A. Kincaid, Bozeman, MT (US)

(73) Assignee: Alliant Techsystems Inc., Minneapolis, MN (US)

( * ) Notice: Subject to any disclaimer, the term of this patent is extended or adjusted under 35 U.S.C. 154(b) by 806 days.

This patent is subject to a terminal disclaimer.

(21) Appl. No.: 11/350,130

(22) Filed: Feb. 8, 2006

(51) Int. Cl.
*B65D 83/00* (2006.01)
*F41C 33/02* (2006.01)

(52) U.S. Cl. ..... 224/243; 224/245; 224/193; 224/912

(58) Field of Classification Search ..... 224/192, 224/193, 198, 238, 243, 244, 911, 912
See application file for complete search history.

(56) References Cited

U.S. PATENT DOCUMENTS

| | | | | |
|---|---|---|---|---|
| 4,318,503 | A | 3/1982 | Capano | |
| 4,858,799 | A * | 8/1989 | Young | 224/243 |
| 5,284,281 | A * | 2/1994 | Nichols | 224/244 |
| 5,419,474 | A | 5/1995 | Marx et al. | |
| 5,518,155 | A | 5/1996 | Gallagher | |
| 5,570,830 | A | 11/1996 | Nichols | |
| 5,573,157 | A | 11/1996 | Mauriello et al. | |
| 5,630,535 | A | 5/1997 | Valenti | |
| 5,810,221 | A | 9/1998 | Beletsky et al. | |
| 5,855,305 | A | 1/1999 | Nichols | |
| 5,918,784 | A | 7/1999 | Serpa | |
| 5,944,239 | A | 8/1999 | Rogers et al. | |
| 6,085,951 | A | 7/2000 | Beletsky et al. | |
| 6,112,962 | A | 9/2000 | Matthews | |
| 2002/0017541 | A1 | 2/2002 | French | |
| 2002/0134803 | A1 | 9/2002 | Lowe et al. | |
| 2002/0153396 | A1 | 10/2002 | French et al. | |
| 2004/0050887 | A1 * | 3/2004 | Spielberger | 224/244 |
| 2005/0035163 | A1 | 2/2005 | French et al. | |
| 2005/0205621 | A1 * | 9/2005 | Shults | 224/198 |
| 2006/0011680 | A1 * | 1/2006 | Cook et al. | 224/243 |
| 2007/0170215 | A1 * | 7/2007 | Evans et al. | 224/192 |
| 2007/0181619 | A1 * | 8/2007 | Seyfert et al. | 224/196 |

* cited by examiner

*Primary Examiner* — Justin Larson
*Assistant Examiner* — Corey Skurdal
(74) *Attorney, Agent, or Firm* — Wooten & Shaddock, PLC

(57) ABSTRACT

A holster for a handgun, comprising a holster body defining a cavity for receiving and holding a handgun; a retention guard pivotably coupled to the body, wherein the retention guard is pivotable between a closed position for securing a handgun within the cavity and an open position for removal of the handgun; and a guard release lever for releasably securing the retention guard in the closed position, wherein the guard release lever is biased to a guard retention position, but wherein the guard release lever is capable of being pivoted to a guard release position when a user's thumb/finger applies a pivoting force to the thumb/finger engagement portion such that the guard locking portion is sufficiently withdrawn from the guard locking means to allow the retention guard to pivot to the open position.

23 Claims, 10 Drawing Sheets

RETENTION HOLSTER HAVING A GUARD AND GUARD RELEASE

BACKGROUND OF THE INVENTION

1. Field of the Invention

The present invention is directed generally to a holster for a weapon such as a handgun. More specifically, the present invention is directed to a generally rigid holster having a guard retention system for securing a handgun such that the handgun is retained or locked in the holster when the holster guard is in a closed position, but may be easily removed from the holster when the holster guard is in an open position.

2. Description of Related Art

Many handgun users, particularly military and law enforcement personnel, carry a handgun in a holster designed to protect the handgun and hold it securely. Holsters can be worn in a number of ways and in a variety of locations on a user's body, such as on the chest, under an arm, at the waist, on the thigh, or around an ankle.

Handgun users must be able to quickly and easily remove the handgun from its holster regardless of the type of holster used or the location of the holster. Additionally, users need to be assured that, when not in use, the handgun will remain safely in the holster. Of equal, or possibly greater importance, the user must be able to quickly secure or re-secure the weapon in the holster when it is not being employed.

Some holsters rely solely on a friction fit between the holster and the handgun to secure the handgun in place. These types of holsters are generally not suitable for situations where the gun/holster is subject to a great deal of movement because such movement could cause the handgun to lose frictional engagement with the holster and allow the handgun to become dislodged from the holster.

Certain other holsters include a variety of strap or flap arrangements that prevent removal of the firearm from the holster while the strap or flap is in place.

Generally, with designs that rely on strap or flap arrangements to retain a handgun, the user must first unfasten and/or rotate a strap or unfasten and open a flap before the firearm can be withdrawn. The user may have to move the strap or flap before the handgun can be re-holstered, typically causing the user to look down at the holster and take his or her eyes off of a possible threat. Then, once the handgun has been re-holstered, the user must physically reposition and refasten the strap or flap before the firearm is securely retained within the holster.

SUMMARY OF THE INVENTION

The prior holster retention systems and methods are often not preferred because of the time and number of steps required to release and/or quickly re-secure the handgun. Furthermore, the prior designs generally require the user to perform some task that interferes with the user establishing a proper initial control grip on the weapon.

Accordingly, the present invention is directed generally to a guarded holster for a weapon such as a handgun. More specifically, in various illustrative, non-limiting embodiments of this invention, the holster comprises a handgun holster having a guard-type retention system. The holster comprises a holster body defining a cavity for receiving and holding the weapon, the holster body having a pair of opposed side walls, a front wall, and a rear wall.

The retention system comprises a spring-biased retaining guard that is pivotably coupled to the holster body, such that the retaining guard is pivotable between a closed position for securing the weapon within the holster cavity and an open position for removal of the weapon. The retaining guard is spring-biased to the open position.

A locking portion of a guard release lever secures the retaining guard in the closed position when a weapon is held in the holster cavity. When the bias of the guard release is overcome, a locking portion associated with the guard release releases the retaining guard to the open position, allowing for removal of the weapon.

In various illustrative, non-limiting embodiments of this invention, when the retaining guard is in the open position, the locking portion of the guard release keeps the retaining guard from pivoting to the closed position until the weapon is placed in the holster cavity, thereby permitting quick re-holstering of the weapon.

In certain exemplary, illustrative, non-limiting embodiments of this invention, at lease one additional retention means is optionally included as part of the guarded holster retention system.

Thus, the present invention comprises a guarded holster type retention system that secures a handgun such that the handgun is retained or locked in the holster when the retention system is engaged, but may be easily removed from the holster when the retention system, and any additional active retention system, is disengaged.

Accordingly, this invention provides a holster, having a simple and reliable quick-release retention system.

This invention separately provides a holster having a retention system, which keeps the retaining guard from pivoting to the closed position until the weapon is placed in the holster cavity, thereby permitting quick and unencumbered re-holstering of the weapon.

This invention separately provides a holster having a retention system, which is capable of retaining a handgun securely in the holster while permitting a quick release of the handgun when the user requires.

This invention separately provides a holster having an optional additional retention system.

This invention separately provides a holster, which is capable of being manufactured using injection molding and/or thermoform production techniques.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
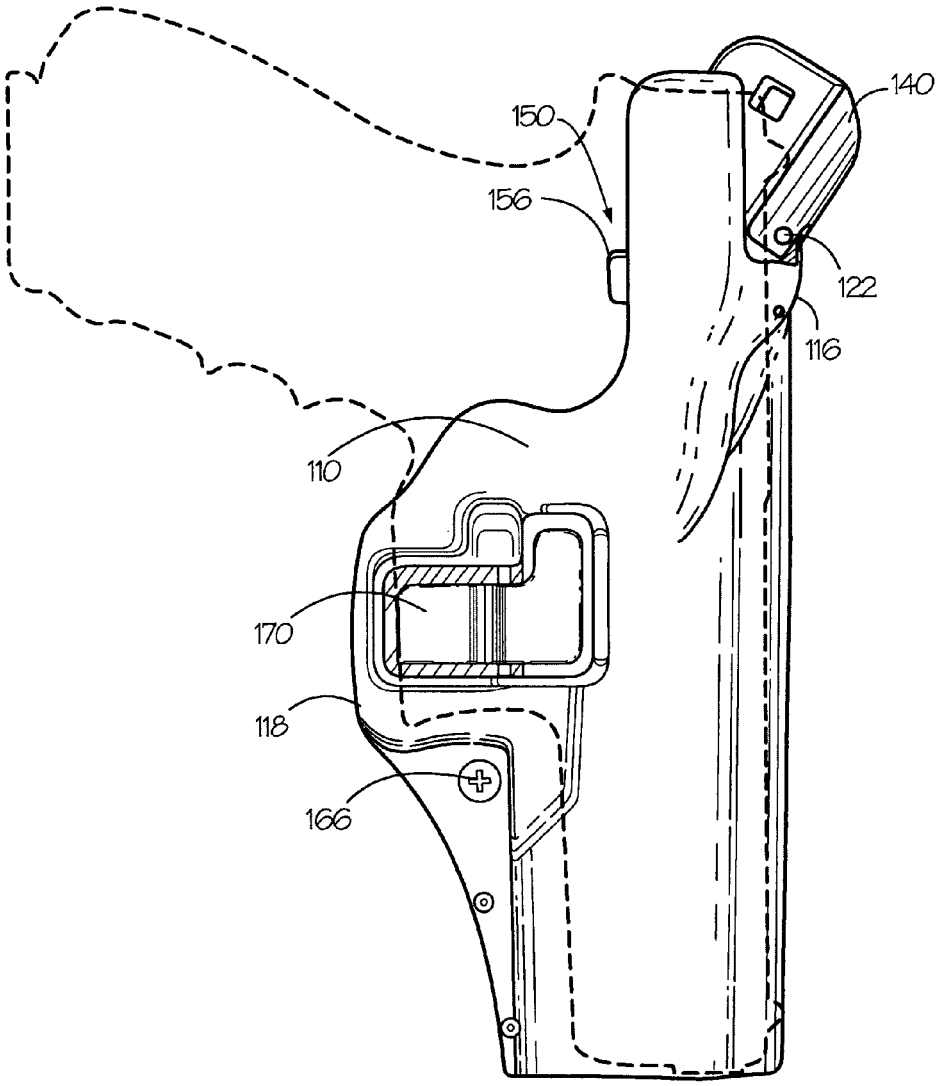
FIG. 1 shows a left side elevation view of a first exemplary embodiment of a handgun holster having a retention system according to this invention, wherein the guard is shown in the open position.

For simplicity and clarification, the design factors and operating principles of the guarded holster according to this invention are explained with reference to various exemplary embodiments of a guarded holster according to this invention. The basic explanation of the design factors and operating principles of the guarded holster is applicable for the understanding, design, and operation of the guarded holster of this invention.

Furthermore, it should be appreciated that, for simplicity and clarification, the embodiments of this invention will be described with reference to a semiautomatic-type handgun being secured within the present guarded holster. However, it should be appreciated that the operating principles of the guarded holster of this invention may also be employed to construct holsters or holders for any revolver or semiautomatic-type handgun, edged weapon, less than lethal product (i.e., a taser, pepper spray, mace canister, baton, or the like), or other device, so long as these items have an appropriate edge, surface, or void that may be engaged or blocked by a pivotable retaining guard.

Furthermore, it is also within the scope of the present invention that the guarded holster may be employed as a holder for tactical accessories, such as ammunition magazines and/or flashlights, as well as for everyday items such as cell phones, personal digital assistants, or the like.

It should also be appreciated that the terms "handgun", "handgun holster", and "weapon" are used for basic explanation and understanding of the operation of the systems, methods, and apparatuses of this invention. Therefore, the terms "handgun", "handgun holster", and "weapon" are not to be construed as limiting the systems, methods, apparatuses, or applications of this invention.

FIGS. 1-9B show various views of a first, illustrative, non-limiting embodiment of a guarded holster 100 having a retention system according to this invention. It should be appreciated that, in various exemplary embodiments, the holster 100 is adapted to retain a semiautomatic-type handgun, as illustrated in phantom in FIG. 1. Generally, semiautomatic-type handguns include a slide and a frame and have a muzzle end and a hammer/firing pin end. The frame generally includes a grip, a trigger guard, and a trigger. The trigger guard includes an inner surface, which defines an area wherein the trigger is located and allows a user's finger access to the trigger, and an outer surface, which defines the outer perimeter of the trigger guard.

As shown in FIGS. 1-9B, the holster 100 includes a holster body 110 defining a cavity 120 for receiving and holding the handgun. The holster body 110 comprises a pair of opposed side walls comprising a first side wall 112 and a second side wall 114. Typically, the first side wall 112 is considered the outer side of the holster and is worn away from the user's body, while the second side wall 114 is considered the inner side of the holster and is worn against or adjacent the user's body.

The holster body 110 further comprises at least some of a front wall 116 and a rear wall 118. In various exemplary embodiments, the front wall 116 and the rear wall 118 may comprise extended portions of the first side wall 112 and the second side wall 114.

It should be noted that the walls of the holster 100 may generally be planar. Alternatively, the walls of the holster 100 may be contoured or shaped to better accommodate a specific type or model of handgun (or other item) to be retained within the holster 100.

In various exemplary embodiments, the holster 100 is substantially rigid and is formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, and/or various combinations of the foregoing. Thus, it should be understood that the material or materials used to form the holster 100 is a design choice based on the desired appearance and/or functionality of the holster 100.

In various exemplary embodiments, the holster 100 includes attachment points 138, which provide means for fastening the holster to a holster holding device such as the holster holding device 105. In various exemplary embodiments, the attachment means 139 may comprise screws, rivets, snap-together parts, eyelets, or any other known or later developed means for attaching or coupling the holster holding device 105 to the attachment points 138.

Alternatively, the attachment points 138 and/or the holster holding device 105 may be replaced by another means for fastening the holster. In various exemplary embodiments, the means for fastening the holster may comprise a clip, loop, or hook adapted to be, for example, clipped over a belt 106. In further exemplary embodiments, the means for fastening the holster may comprise one or more quick-disconnect or other couplings provided on or adjacent the second side wall 114 of the holster 100, which may be permanently or removably coupled to corresponding and cooperating coupling(s) provided on a belt, carrier, or platform. In still other exemplary embodiments, the holster 100 may comprise an integral belt or one or more connections for attachment to a chest, ankle, leg, shoulder, or other harness or band, or for otherwise securing the holster to a user or the user's apparel.

In various exemplary, non-limiting embodiments, the holster 100 optionally comprises an active retention system 170. The active retention system 170, if included, is capable of retaining a handgun securely in the holster 100 by restricting withdrawal of the handgun from the cavity 120 of the holster 100 until the active retention system 170 is disengaged.

In various exemplary, non-limiting embodiments, the active retention system 170, if included, comprises the latch device as shown and described in U.S. Pat. No. 5,918,784 entitled Quick-release Handgun Holster, the entire disclosure of which is incorporated herein by reference. In still other exemplary embodiments, the active retention system 170 comprises the retention system as shown and described in U.S. patent application Ser. No. 11/030,270 entitled Holster Retention System, the entire disclosure of which is incorporated herein by reference.

In various exemplary embodiments, one or both of the side walls include optional slots 162 and 164, which define a passive retention portion 160. Although not shown in the present figures, the inner surface of the passive retention portion 160 may optionally include one or more raised or textured areas, which provide for additional frictional engagement between the inner surface of the passive retention portion 160 and the trigger guard of the handgun. One or more retention screws 166 may be tightened or loosened to adjust the degree of frictional retention of the handgun by the passive retention portion 160.

The passive retention portion 160, if included, may be adjusted, via the one or more retention screws 166, to provide an adjustable frictional tension between the passive retention portion 160 and the handgun trigger guard, without increasing the frictional tension between a remaining portion of the holster 100 and the handgun.

As further shown in FIGS. 1-9B, the holster 100 includes a retention guard 140 pivotably coupled to the body 110. The retention guard 140 is pivotable between a closed position for securing the weapon within the cavity 120, as illustrated, for example, in FIGS. 1, 2A, 6A, and 7A, and an open position for removal of the weapon, as illustrated, for example, in FIGS. 2B, 2C, 6B, and 7B.

The retention guard 140 is pivotably coupled to the body 110, via a fulcrum or guard pivot pin 122. In various exemplary embodiments, the retention guard 140 is pivotably coupled to a portion of the front wall 116, via the guard pivot pin 122. Alternatively, the retention guard 140 may be pivotably coupled to a portion of the first side wall 112 and/or the second side wall 114, via the guard pivot pin 122. In various exemplary embodiments, the pivot pin 158 may extend all or part of the way across the width of the holster 100.

The retention guard 140 may be pivotably coupled to the body 110, via a snap-mating pivot clamp formed as a portion of the retention guard 140 and a guard pivot formed as a portion of the front wall 116.

The retention guard 140 is biased to the open position by a guard biasing means 124. In various exemplary embodiments, the guard biasing means 124 comprises a portion of spring steel or a spring-biased coil. Alternatively, the guard biasing means 124 may comprise an extension or finger that extends from either the retention guard 140 or a portion of the body 110 that provides a biasing force to the retention guard 140 relative to the body 110.

In still other exemplary embodiments, the pivot pin 122 and the guard biasing means 124 comprise a biased portion of a material that couples the retention guard 140 to the body 110.

In various exemplary embodiments, the retention guard 140 comprises a guard travel stop 144, which corresponds to a guard travel guide 134 formed in the body 110. The guard travel stop 144 protrudes into the guard travel guide 134 such that the guard travel guide 134 defines an arc of rotation of the retention guard 140 relative to the body 110. In various exemplary embodiments, the retention guard 140 comprises two guard travel stops 144, each of which corresponds to a guard travel guide 134 formed in the body 110. As shown in the drawing figures, the retention guard 140 includes a first guard travel stop 144, which corresponds to a guard travel guide 134 formed in the first side wall 112, and a second guard travel stop 144', which corresponds to a guard travel guide 134' formed in the second side wall 114.

Alternatively, the body 110 may comprise a guard travel stop (not shown), which corresponds to a guard travel guide (not shown) formed in the retention guard 140. In these exemplary embodiments, the guard travel stop protrudes into the guard travel guide such that the guard travel guide defines an arc of rotation of the retention guard 140 relative to the body 110. The body 110 may include a first guard travel stop (not shown) formed in the first side wall 112, which corresponds to a guard travel stop (not shown), and a second guard travel stop (not shown) formed in the second side wall 114, which corresponds to a guard travel stop (not shown).

The guard release lever 150 includes a first side facing generally outward from the holster 100, away from the cavity 120 formed by the holster 100, and a second side facing toward the cavity 120 formed by the holster 100. The guard release lever 150 comprises at least some of a thumb/finger engagement portion 152 and a guard engagement portion 154. The thumb/finger engagement portion 152 and the guard engagement portion 154 are generally separated by a fulcrum or pivot pin 158.

In various exemplary embodiments, the thumb/finger engagement portion 152 is smooth and non-textured such that the thumb/finger engagement portion 152 will not impede the user's thumb/finger as the user's thumb/finger applies a pivoting force to the guard release 150, pivots the guard release 150 to a guard release position, and establishes a grip on the frame of the handgun. Alternatively, the first side of the thumb/finger engagement portion 152 may include a textured portion (not shown) so that the thumb/finger engagement portion 152 may be distinguished tactilely from other portions of the guard release lever 150 or the holster 100.

In various exemplary, non-limiting embodiments, guard release lever 150 is pivotally connected to the second side wall 114, via a fulcrum or pivot pin 158. In various exemplary embodiments, the pivot pin 158 is positioned substantially parallel to a vertical axis of the holster 100, substantially perpendicular to a vertical axis of the holster 100, at a substantially acute angle relative to a vertical axis of the holster 100, or at a substantially obtuse angle relative to a vertical axis of the holster 100. Thus, the pivot pin 158 may be positioned at any angle relative to a vertical axis of the holster 100.

In various exemplary embodiments, the pivot pin 158 may extend all or part of the way across the width of the guard release lever 150.

In various exemplary embodiments, a ridge 135 is formed on the first side wall 112 around at least a portion of the guard release lever 150. Generally, the ridge 135 does not contact the guard release lever 150, but provides a perimeter around at least a portion of the guard release lever 150 to reduce the likelihood of the guard release lever 150 being inadvertently manipulated. The ridge 135 may include a guard release lever anti-snag portion 135', which is formed so as to keep items from accidentally snagging or hooking the guard release lever 150.

The ridge 135 may include a textured portion (not shown). In this manner, the ridge 135 may be distinguished tactilely from other portions of the holster 100 or the guard release lever 150.

While FIGS. 1-9B show the guard release lever 150 coupled to the second side wall 114, it should be appreciated that in various exemplary embodiments, the guard release lever 150 may be coupled to the first side wall 112.

The guard release lever 150 is pivotable between a guard retention position for securing the retention guard 140 in the closed position and a guard release position for releasing the retention guard 140 and allowing the retention guard 140 to pivot to the open position. In various exemplary embodiments, the guard release lever 150 is biased to the guard retention position whether the retention guard 140 is in the closed position or the open position.

In various exemplary embodiments, the guard release lever 150 is biased to the guard retention position by, for example, a spring means 159. In various exemplary embodiments, the spring means 159 comprises a portion of spring steel or a spring-biased coil. Alternatively, the spring means 159 may comprise an extension or finger that extends from either the guard release lever 150 or a portion of the body 110 that provides a biasing force to the guard release lever 150 relative to the body 110.

The guard engagement portion 154 includes a guard locking portion 155, formed of a protrusion on the second side of the guard engagement portion 154. In various exemplary embodiments, the guard locking portion 155 includes a substantially planar portion 156 and a ramp portion 157. The guard locking portion 155 may also include an optional detent 155'.

When the guard release lever 150 is in the guard retention position, the guard locking portion 155 protrudes from the second side of the guard engagement portion 154, and extends through an aperture 132 in the second side wall 114 of the holster body 110, into a portion of the cavity 120 formed in the holster 100. When the retention guard 140 is in the closed position and the guard release 150 is in the guard retention position, the guard locking portion 155 protrudes from the second side of the guard release 150, through an aperture 132 in the second side wall 114 of the holster body 110, and engages a guard locking means 142 formed in the retention guard 140, thereby maintaining the retention guard 140 in the closed position.

In various exemplary embodiments, the guard locking means 142 comprises an aperture formed in the retention guard 140. Alternatively, the guard locking means 142 may comprise an indent or notch formed in the retention guard 140.

The optional detent 155', if included, is formed so as to mate with an optional corresponding inner surface protrusion 142' formed in the guard locking means 142. Since the retention guard 140 is biased to the open position, the mating of the detent 155' and the inner surface protrusion 142' provides an additional measure of resistance to the bias of the guard release 150.

When the bias of the guard release 150 is overcome and the guard release 150 is pivoted from the guard retention position to the guard release position, the guard locking portion 155 is withdrawn from the guard locking means 142 and the retention guard 140 is allowed to pivot to the open position. When the retention guard 140 is in the open position, the handgun may be removed from the holster 100.

It should be appreciated that if the optional active retention system 170 is included, the handgun may not be removed from the holster 100 until the active retention system 170 is disengaged.

When the retention guard 140 is in the open position and the pivoting force is removed from the guard release 150, the guard release 150 returns to the biased guard retention position. In the guard retention position, the guard locking portion 155 protrudes through the aperture 132 in the second side wall 114 of the holster body 110 into the cavity 120.

In various illustrative, non-limiting embodiments of this invention, when the retention guard 140 is in the open position, the substantially planar portion 156 of the guard locking portion 155 protrudes into the cavity 120 so as to block the retention guard 140 from being pivoted to the closed position.

When the handgun is returned to the cavity 120, the slide or other portion of the inserted handgun contacts a terminal end of the guard locking portion 155 and displaces the guard locking portion 155 sufficient to pivot the guard release 150 such that the substantially planar portion 156 of the guard locking portion 155 is displaced out of the cavity 120. Thus, the substantially planar portion 156 no longer protrudes far enough into the cavity 120 to block the retention guard 140 from being pivoted to the closed position.

In various illustrative, non-limiting embodiments of this invention, the holster 100 includes at least one biased guard lock 136. An inner surface of the guard lock 136 includes one or more raised areas, or guard lock protrusions 137. In the naturally biased position, a portion of the guard lock 136 and the guard lock protrusion 137 protrude into the cavity 120 when the retention guard 140 is in the open position.

Thus, when the retention guard 140 pivots to the open position, the guard lock 136, if included, returns to a naturally biased guard locking position. In the guard locking position, a portion of the guard lock 136 and the guard lock protrusion 137 protrude into the cavity 120.

In various illustrative, non-limiting embodiments of this invention, when the retention guard 140 is in the open position, a portion of the guard lock 136 protrudes into the cavity 120 so as to block the retention guard 140 from being pivoted to the closed position.

When the handgun is returned to the cavity 120, the slide or other portion of the inserted handgun contacts an end of the guard lock protrusion 137 and displaces the guard lock protrusion 137 sufficient to flex the guard lock 136 such that the guard lock 136 is displaced out of the cavity 120 sufficient to allow the retention guard 140 to be pivoted to the closed position.

During use of the holster 100, the holster 100 is initially presented in an empty condition with the retention guard 140 biased to the open position. When in the open position, the retention guard 140 is blocked by the substantially planar portion 156 of the guard locking portion 155, and/or the portion of the guard lock 136, from being pivoted to the closed position.

As a user begins to holster a handgun in the holster 100, the handgun is inserted into the cavity 120 of the holster, muzzle first, and is guided into position by at least some of the first side wall 112, the second side wall 114, the front wall 116, and the rear wall 118.

As the handgun is inserted further into the cavity 120, an outer surface of the handgun contacts the terminal end of the guard locking portion 155 and/or an end of the guard lock protrusion 137. When the handgun is seated in the cavity 120, contact between the outer surface of the handgun and the terminal end of the guard locking portion 155 displaces the guard locking portion 155 from the cavity 120 a sufficient amount such that the substantially planar portion 156 no longer protrudes far enough into the cavity 120 to block the retention guard 140 from being pivoted to the closed position.

Likewise, contact between the outer surface of the handgun and the end of the guard lock protrusion 137 displaces the guard lock protrusion 137 sufficient to flex the guard lock 136, if included, such that the guard lock 136 is displaced out of the cavity 120 sufficient to allow the retention guard 140 to be pivoted to the closed position.

When the handgun in seated in the cavity 120 and the retention guard 140 is manually pivoted towards the closed position, a portion of the retention guard 140 contacts the ramp portion 157 of the guard locking portion 155. The shape of the ramp portion 157 allows the guard locking portion 155 to be displaced from the cavity 120 as a contact portion of the retention guard 140 rides along the surface of the ramp portion 157.

As the retention guard 140 continues to be pivoted towards the closed position, the terminal end of the guard locking portion 155 rides along a contact portion of the retention guard 140, the retention guard 140 continues to displace the guard locking portion 155 from the cavity 120, and the guard release 150 continues to pivot until the terminal end of the guard locking portion 155 passes a point of contact with the retention guard 140 and the guard locking portion 155 engages the guard locking means 142.

Figure 2A:
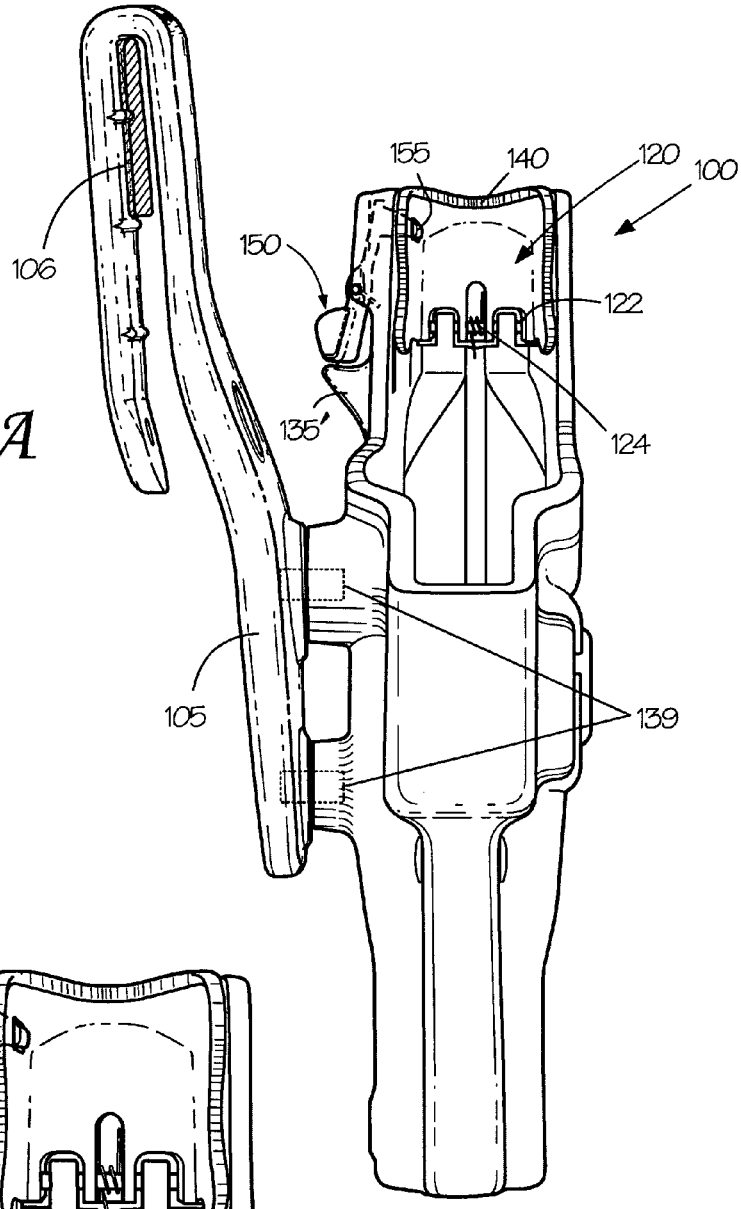
FIG. 2A shows a rear elevation view of a first exemplary embodiment of a handgun holster having a retention system according to this invention, wherein the guard release lever is biased to a guard retention position and the guard is in a closed position.
Figure 2B:
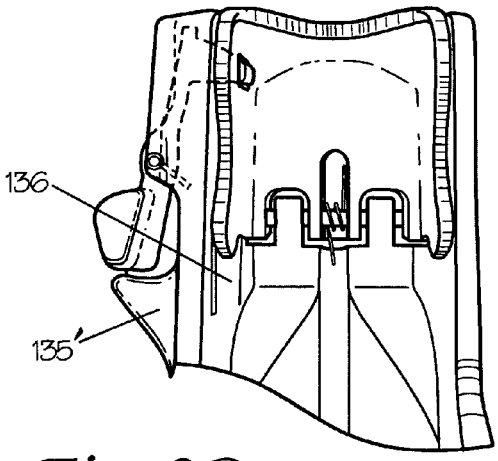
FIG. 2B shows a more detailed view of the release system of the first exemplary embodiment of the handgun holster of FIG. 2A, wherein the guard release lever is biased to a guard retention position and the guard is in a closed position according to this invention.
Figure 2C:
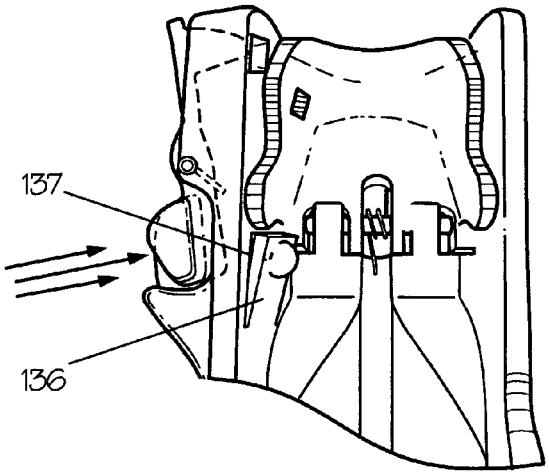
FIG. 2C shows a more detailed view of the release system of the first exemplary embodiment of the handgun holster of FIG. 2A, wherein the guard release lever is biased to a guard release position and the guard is biased to an open position according to this invention.
Figure 2D:
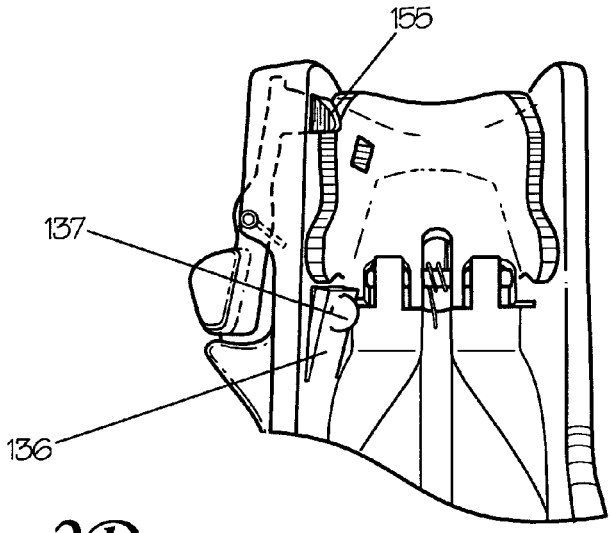
FIG. 2D shows a more detailed view of the release system of the first exemplary embodiment of the handgun holster of FIG. 2A, wherein the guard release lever is biased to a guard retention position and the guard is biased to an open position according to this invention.
Figure 3:
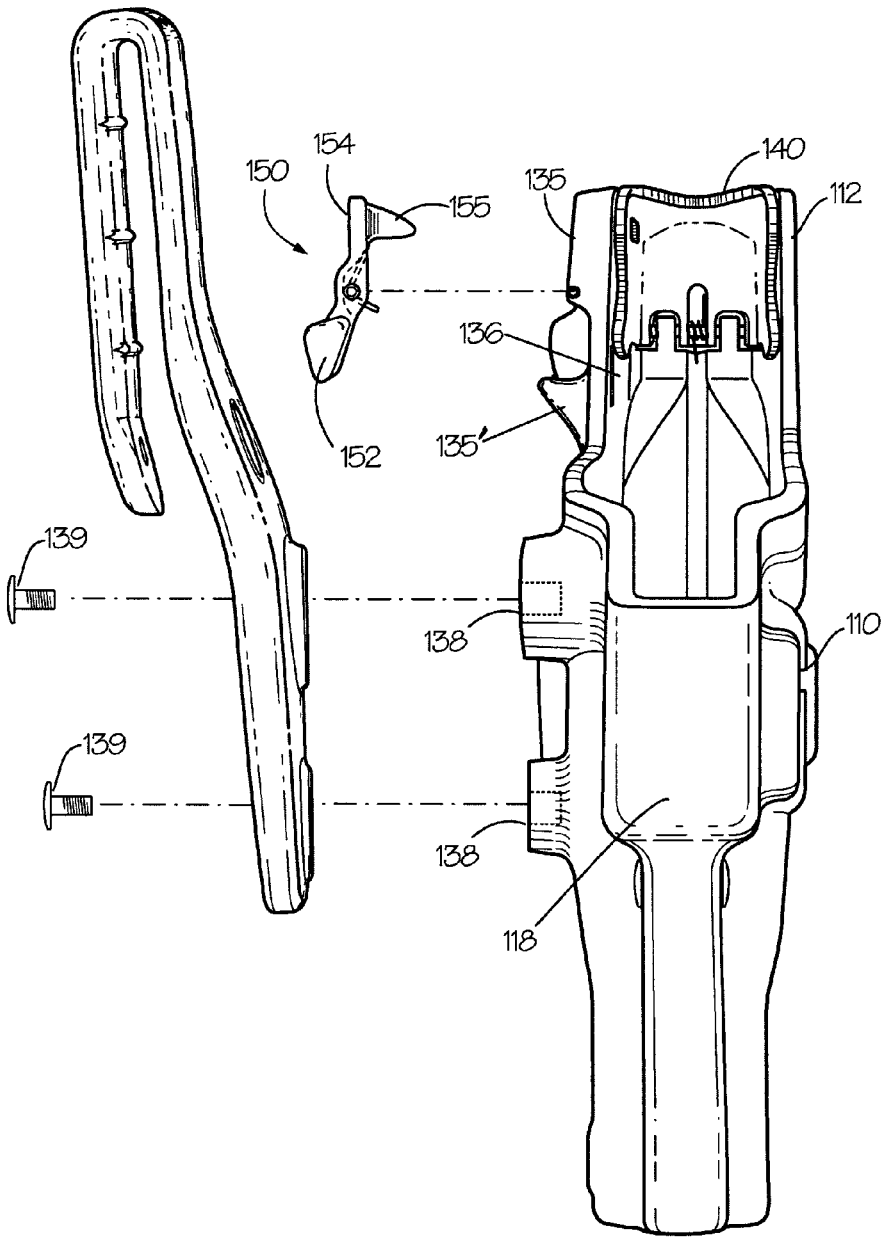
FIG. 3 shows a partial exploded rear elevation view of a first exemplary embodiment of a handgun holster having a retention system according to this invention.
Figure 4A:
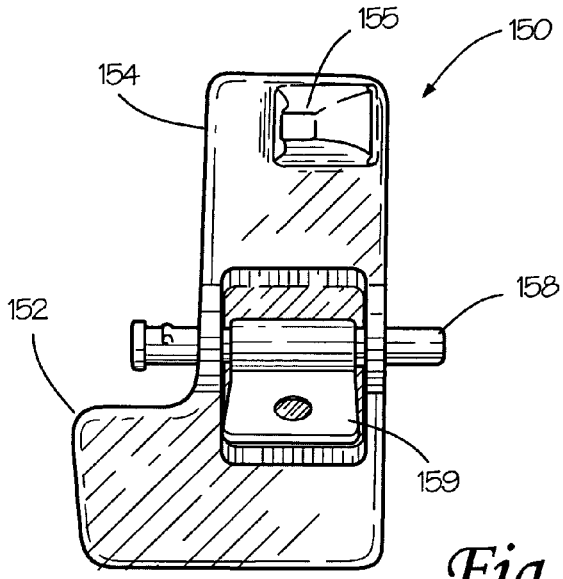
FIG. 4A shows a side elevation view of a first exemplary embodiment of the guard release lever according to this invention.
Figure 4B:
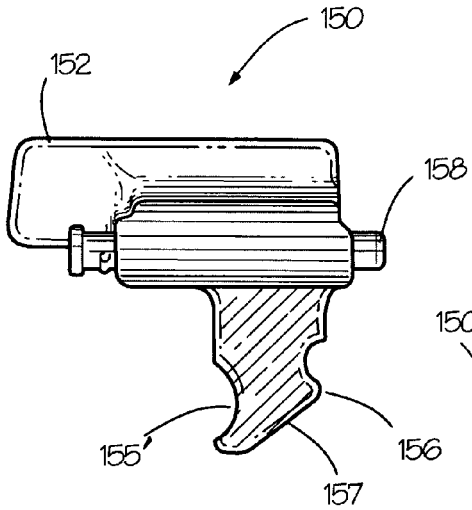
FIG. 4B shows a top view of a first exemplary embodiment of the guard release lever according to this invention.
Figure 4C:
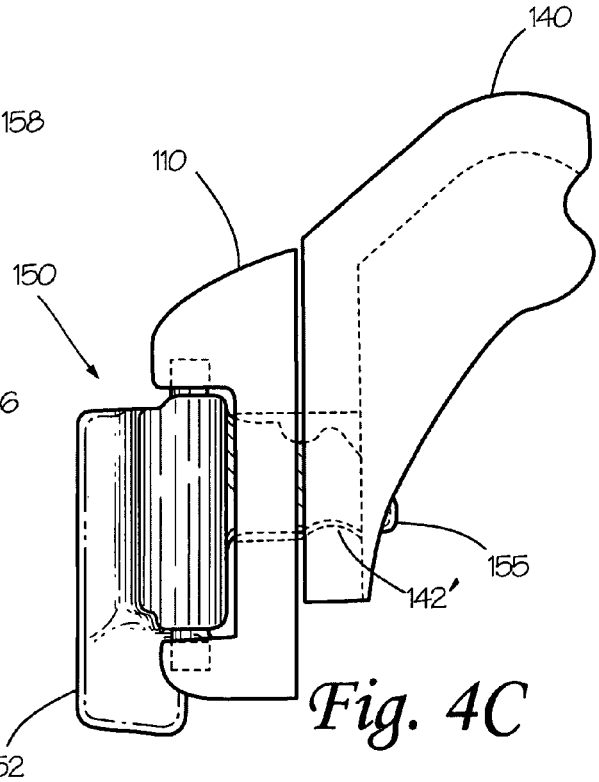
FIG. 4C shows a top view of a first exemplary embodiment of the guard release lever, wherein the guard release lever is biased to a guard retention position and the guard is maintained in a closed position according to this invention.

When the guard locking portion 155 engages the guard locking means 142, the bias of the guard release 150 causes the guard release 150 to return to the biased guard retention position, as illustrated in FIGS. 2A and 2C.

When the retention guard 140 is in the closed position and the guard release 150 is biased to the guard retention position, the guard locking portion 155 protrudes, from the guard release 150, through the aperture 132 in the second side wall 114 of the holster body 110, and engages the guard locking means 142 formed in the retention guard 140, thereby maintaining the retention guard 140 in the closed position.

Thus, the handgun is secured in the cavity 120 of the holster by operation of the guard locking portion 155 maintaining the retention guard 140 in a closed position, thereby blocking removal of the handgun. While the handgun is fully seated in the cavity 120, with the retention guard 140 maintained in the closed position, removal of the handgun is not permitted, as the retention guard 140 covers at least a portion of the handgun (i.e., the rear slide, the hammer, or the backstrap, depending on the type and model of firearm) and does not allow the handgun to pass by.

Figure 5:
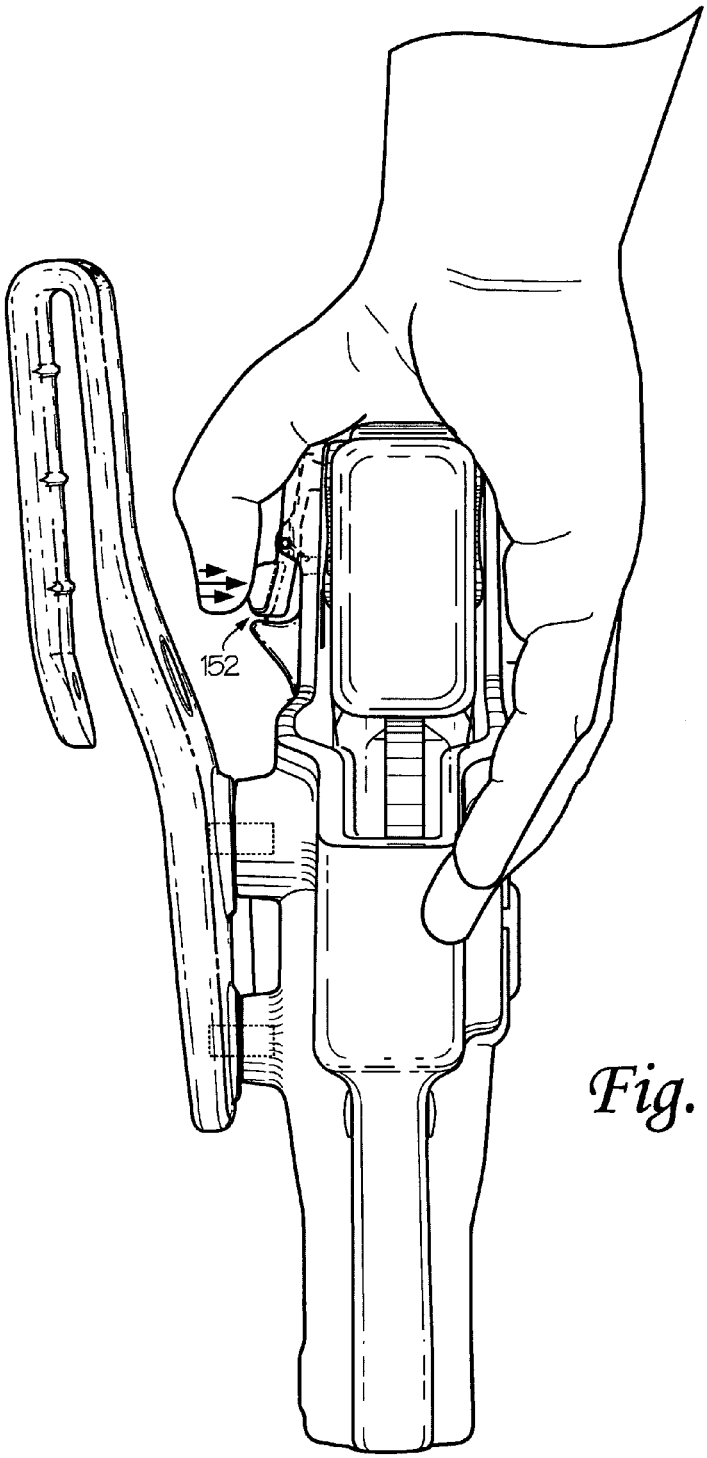
FIG. 5 shows a rear elevation view of a first exemplary embodiment of a handgun holster having a retention system, further illustrating a user's thumb pivoting the guard release lever to a guard release position according to this invention.
Figure 6A:
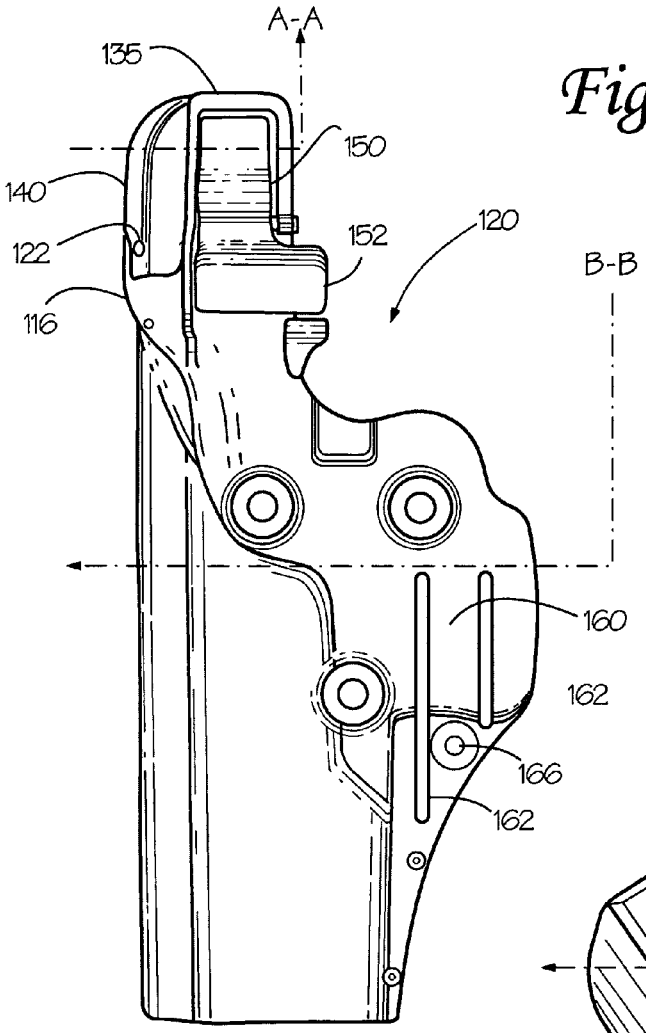
FIG. 6A shows a right side elevation view of a first exemplary embodiment of a handgun holster having a retention system, wherein the guard is shown in the closed position according to this invention.
Figure 6B:
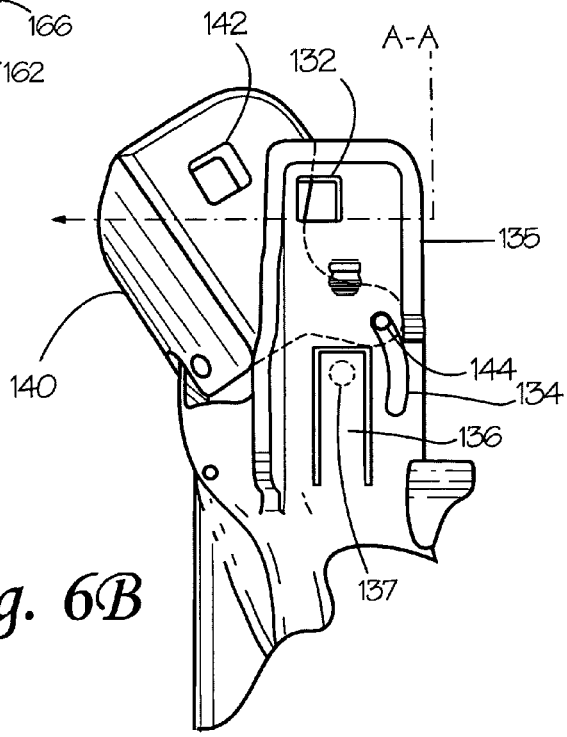
FIG. 6B shows a more detailed view of the guard area of FIG. 6A, wherein the guard is shown in the opened position according to this invention.
Figure 7A:
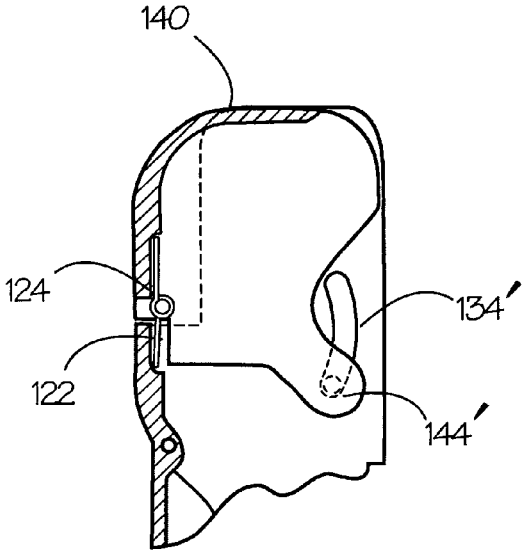
FIG. 7A shows a cross-sectional view of the guard area of the first exemplary embodiment of the handgun holster having a retention system according to this invention, wherein the guard is shown in the closed position.
Figure 7B:
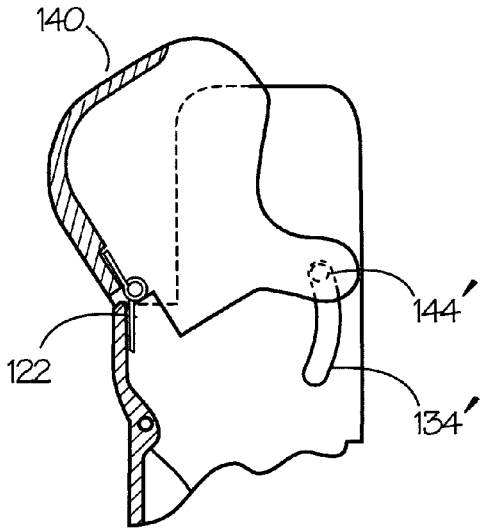
FIG. 7B shows a cross-sectional view of the guard area of the first exemplary embodiment of the handgun holster having a retention system according to this invention, wherein the guard is shown in the opened position.
Figure 8:
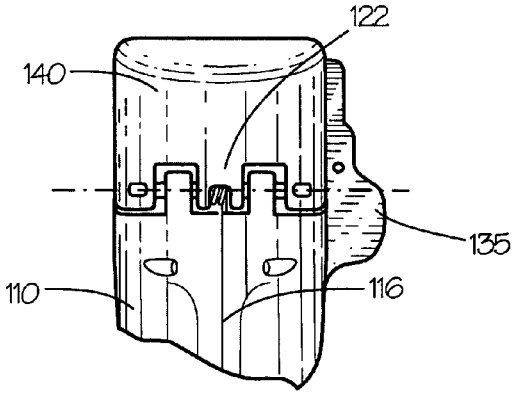
FIG. 8 shows a front elevation view of the guard area of the first exemplary embodiment of the handgun holster having a retention system according to this invention.
Figure 9A:
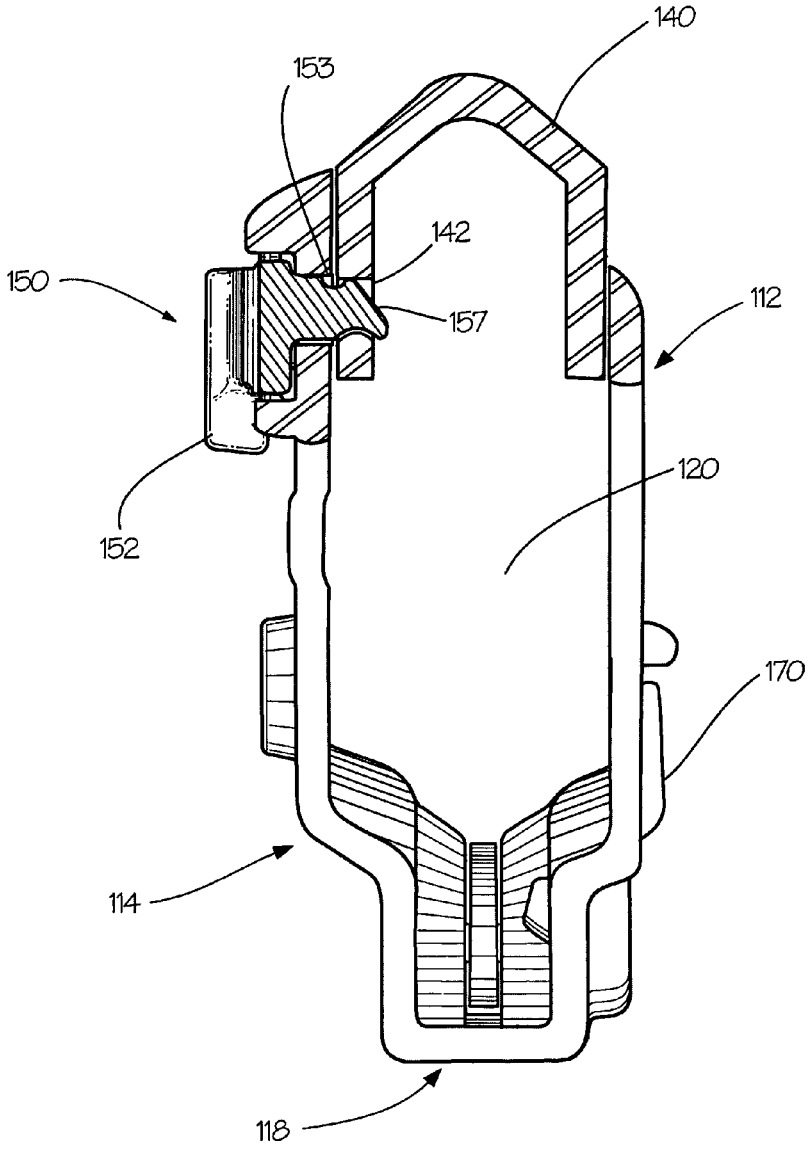
FIG. 9A shows a top cross-sectional view taken along line A-A of the handgun holster of FIG. 6A, illustrating the first exemplary embodiment of the retention system according to this invention in greater detail.
Figure 9B:
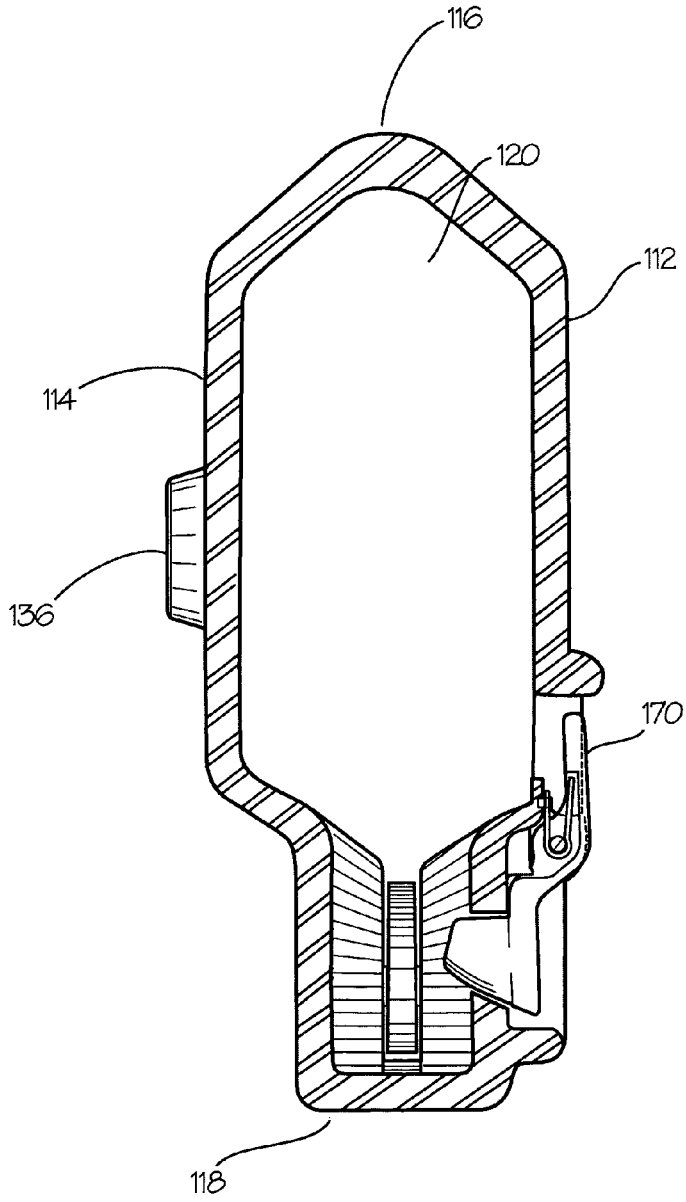
FIG. 9B shows a top cross-sectional view taken along line B-B of the handgun holster of FIG. 6A, illustrating the first exemplary embodiment of the retention system according to this invention in greater detail.

In order to release and unholster the handgun, the user merely grasps the handgun in a manner to establish a normal grip on the handgun. As the user's grip is established, the user's thumb may contact and apply a force to the thumb/finger engagement portion 152, as illustrated in FIG. 5, such that the guard release lever 150 is pivoted to a guard release position, as illustrated in FIG. 2B.

As the bias of the guard release 150 is overcome, the guard release 150 is pivoted to the guard release position and the guard locking portion 155 is withdrawn from the guard locking means 142. When the guard release 150 is pivoted sufficiently such that the guard locking portion 155 is sufficiently withdrawn from the guard locking means 142 and the guard locking portion 155 clears or disengages from the guard locking means 142, the bias of the retention guard 140 automatically pivots the retention guard 140 to the open position.

When the retention guard 140 is in the open position, a removal force may be applied to the handgun and the handgun may be removed from the holster 100.

It should be appreciated that if any additional optional active retention system(s) is/are included, such as, for example, the active retention system 170, the handgun may not be removed from the holster 100 until the retention guard 140 is in the open position and any active retention system(s) is/are disengaged or overcome.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A holster, comprising:

a holster body defining a cavity;

a retention guard pivotably coupled to the holster body, wherein the retention guard is pivotable between a closed position and an open position, wherein the retention guard is biased to the open position by a guard biasing means, and wherein the retention guard includes a guard locking indent for receiving at least a portion of a guard locking portion; and a guard release lever, wherein the guard release lever includes at least some of the guard locking portion and a thumb/finger engagement portion, wherein the guard release lever is coupled to the holster body such that if the guard locking portion is pivoted towards the cavity the thumb/finger engagement portion pivots away from the cavity, wherein when the guard release lever is in a guard retention position and the retention guard is in the closed position, at least a portion of the guard locking portion protrudes through an aperture in the holster body and into the guard locking indent of the retention guard to maintain the retention guard in the closed position, and wherein if the guard release lever is pivoted to a guard release position the guard locking portion is sufficiently withdrawn from the guard locking indent so as to allow the retention guard to automatically pivot, via a biasing force provided by the guard biasing means, to the open position.

2. The holster of claim 1, wherein the retention guard is precluded from pivoting to the closed position when a handgun is absent from the cavity.

3. The holster of claim 2, wherein the guard locking portion precludes the retention guard from pivoting to the closed position when a handgun is absent from the cavity.

4. The holster of claim 1, wherein the holster body comprises a first side wall, a second side wall, a front wall, and a rear wall.

5. The holster of claim 1, wherein the retention guard is pivotably attached to opposed side walls of the holster body.

6. The holster of claim 1, wherein the retention guard is pivotably attached to a front wall of the holster body.

7. The holster of claim 1, wherein the retention guard is pivotably coupled to the holster body, via a snap-mating pivot clamp formed as a portion of the retention guard and a guard pivot formed as a portion of a front wall of the holster body.

8. The holster of claim 1, wherein at least a portion of the holster body of the holster is contoured to accommodate a specific model of handgun.

9. The holster of claim 1, wherein the holster body further comprises at least one means for fastening the holster.

10. The holster of claim 1, wherein the holster body further comprises at least one attachment point for coupling the holster to a holster holding device.

11. The holster of claim 1, wherein the holster further comprises an active retention system, wherein the active retention system is capable of retaining a handgun in the holster by restricting withdrawal of the handgun from the cavity of the holster until the active retention system is disengaged.

12. The holster of claim 1, wherein the holster further comprises a passive retention portion, wherein the passive retention portion is capable of providing a degree of frictional retention of a handgun by the holster.

13. The holster of claim 1, wherein the guard biasing means comprises a portion of spring steel.

14. The holster of claim 1, wherein the guard biasing means comprises an extension that extends from the retention guard and provides a biasing force to the retention guard relative to the holster body.

15. The holster of claim 1, wherein the guard biasing means comprises an extension that extends from a portion of the holster body and provides a biasing force to the retention guard relative to the holster body.

16. The holster of claim 1, wherein the guard biasing means comprises a biased portion of a material that couples the retention guard to the holster body.

17. The holster of claim 1, wherein the retention guard comprises a guard travel stop, which corresponds to a guard travel guide formed in the holster body and protrudes into the guard travel guide such that the guard travel guide defines an arc of rotation of the retention guard relative to the holster body.

18. The holster of claim 1, wherein the holster body comprises a guard travel stop, which corresponds to a guard travel guide formed in the retention guard and protrudes into the guard travel guide such that the guard travel guide defines an arc of rotation of the retention guard relative to the holster body.

19. The holster of claim 1, wherein the guard locking portion is formed of a protrusion on the guard release lever.

20. The holster of claim 1, wherein the guard locking indent is an aperture formed through the retention guard.

21. The holster of claim 1, wherein the guard release lever is coupled directly the holster body.

22. The holster of claim 1, wherein the guard release lever is formed as an integral portion of the holster body.

23. The holster of claim 1, further comprising at least one biased guard lock, wherein an inner surface of the guard lock the biased guard lock includes at least one guard lock protrusion, wherein the biased guard lock is biased such that when the retention guard is in the open position at least a portion of the guard lock protrudes into the cavity so as to block the retention guard from being pivoted to the closed position, and wherein when a handgun is inserted in the cavity, a portion of the inserted handgun contacts an end of the guard lock protrusion and displaces the guard lock protrusion sufficient to flex the guard lock such that the guard lock is displaced out of the cavity sufficient to allow the retention guard to be pivoted to the closed position.

* * * * *

UNITED STATES PATENT AND TRADEMARK OFFICE

CERTIFICATE OF CORRECTION

PATENT NO. : 8,235,263 B1
APPLICATION NO. : 11/350130
DATED : August 7, 2012
INVENTOR(S) : Eric M. Yeates et al.

It is certified that error appears in the above-identified patent and that said Letters Patent is hereby corrected as shown below:

Claim 21, under Column 12, Line 25, delete “directly the” and insert --directly to the--.

Signed and Sealed this
Twenty-third Day of October, 2012

David J. Kappos

David J. Kappos
*Director of the United States Patent and Trademark Office*